US006446848B1

(12) United States Patent
Swisher

(10) Patent No.: US 6,446,848 B1
(45) Date of Patent: Sep. 10, 2002

(54) BOOT JACK

(75) Inventor: Steven L. Swisher, Tulsa, OK (US)

(73) Assignee: Richard Trent Morris, Tulsa, OK (US)

( * ) Notice: Subject to any disclaimer, the term of this patent is extended or adjusted under 35 U.S.C. 154(b) by 0 days.

(21) Appl. No.: 09/850,467

(22) Filed: May 7, 2001

(51) Int. Cl.[7] ..... A47G 25/80

(52) U.S. Cl. ..... 223/112; 223/116; 223/113; 223/114; 223/DIG. 2; 135/66

(58) Field of Search ..... 223/116, 113, 223/114, 112, DIG. 2; 135/66

(56) References Cited

U.S. PATENT DOCUMENTS

| | | | | |
|---|---|---|---|---|
| 4,666,070 A | | 5/1987 | McClung | |
| 4,760,942 A | | 8/1988 | Kadar | |
| 5,046,650 A | | 9/1991 | Rothenberg et al. | |
| 5,050,784 A | | 9/1991 | Turner | |
| D320,691 S | | 10/1991 | Rose | |
| 5,054,667 A | | 10/1991 | Levy et al. | |
| 5,056,545 A | * | 10/1991 | Spaeth | 135/66 |
| D372,113 S | | 7/1996 | Palmer et al. | |
| 5,566,868 A | * | 10/1996 | Mariscal et al. | 223/113 |

* cited by examiner

*Primary Examiner*—Rodney M. Lindsey
*Assistant Examiner*—James G Smith
(74) *Attorney, Agent, or Firm*—Molly D. McKay

(57) ABSTRACT

A boot jack that is removably attachable to a distal end of a rod so that the individual can grasp a proximal end of the rod and use the boot jack to remove their shoes while either sitting or standing. The boot jack has a v-shaped part between which the user can place the heel of their shoe to removably engage the shoe with the boot jack. A clamping structure attaches to the v-shape part for removably securing the boot jack around the distal end of the rod so that the boot jack extends outward away from the rod at approximately a 90-degree angle from the longitudinal axis of the rod.

5 Claims, 3 Drawing Sheets

BOOT JACK

BACKGROUND OF THE INVENTION

1. Field of the Invention

The present invention relates to a boot jack that is removably attachable to a distal end of a rod so that the user can grip a proximal end of the same rod with their hand to remove their shoes while remaining in either a standing or sitting position. The invention is preferably to be used in conjunction with a device to assist a person in putting on their shoes, such as the invention taught in U.S. Pat. No. 5,065,917 to inventor Diehm.

2. Description of the Related Art

Various devices have been employed to assist a person in removing footwear from their feet. Some of these devices are designed to rest on the floor so that the shoe is wedged or clamped to the device and then the person lifts the foot on which the shoe is being worn to thus remove the shoe from the foot. Often, the user will be required to step on the device with the other foot during the time that the foot is being raised in order to provide the necessary force to remove the shoe. This type of device is hard for elderly people to use, particularly if they have problems with their legs or back, with balance, or with strength.

Another type of device that has been used to assist a person in removing their shoes is one that is provided with a long handle so that the user can grasp the handle with one hand and engage the shoe with an opposite end of the handle to remove the shoe. A modification of the type of invention is provided with two long handles so that the user can grasp the handles with both of their hands. These types of devices are usually made as unitary tools that can only serve the single purpose of removing shoes.

The present invention improves over the previous shoe and boot removing devices in that it is removably attachable to an existing rod or to an existing device for assisting a person in putting on their shoes or socks. By being removably attachable in this manner, the present invention can be added to existing handles to add new functionality to devices or handles.

Because the invention is removably attachable to a rod or handle, the invention can be removed form its original rod or handle and reattached to a new rod or handle in the event that the original rod or handle is broken or damaged.

The small size and weight of the invention also makes it easier and less expensive to make and to ship.

SUMMARY OF THE INVENTION

The present invention is a boot jack that is removably attachable to a distal end of a rod so that the boot jack can be used by an individual to remove their shoes while the individual is either sitting or standing and while the individual holds the opposite proximal end of the rod in their hand.

The invention is provided with a v-shaped part that extends outward away from the rod so that the user can place the heel of their shoe within the v-shaped part to engage the shoe with the invention while holding the opposite end of the rod. The invention is provided with a clamping structure for securing the boot jack around the distal end of the rod so that the boot jack extends outward away from the rod at approximately a 90-degree angle from the longitudinal axis of the rod.

DETAILED DESCRIPTION OF THE PREFERRED EMBODIMENT

THE INVENTION

Figure 1:
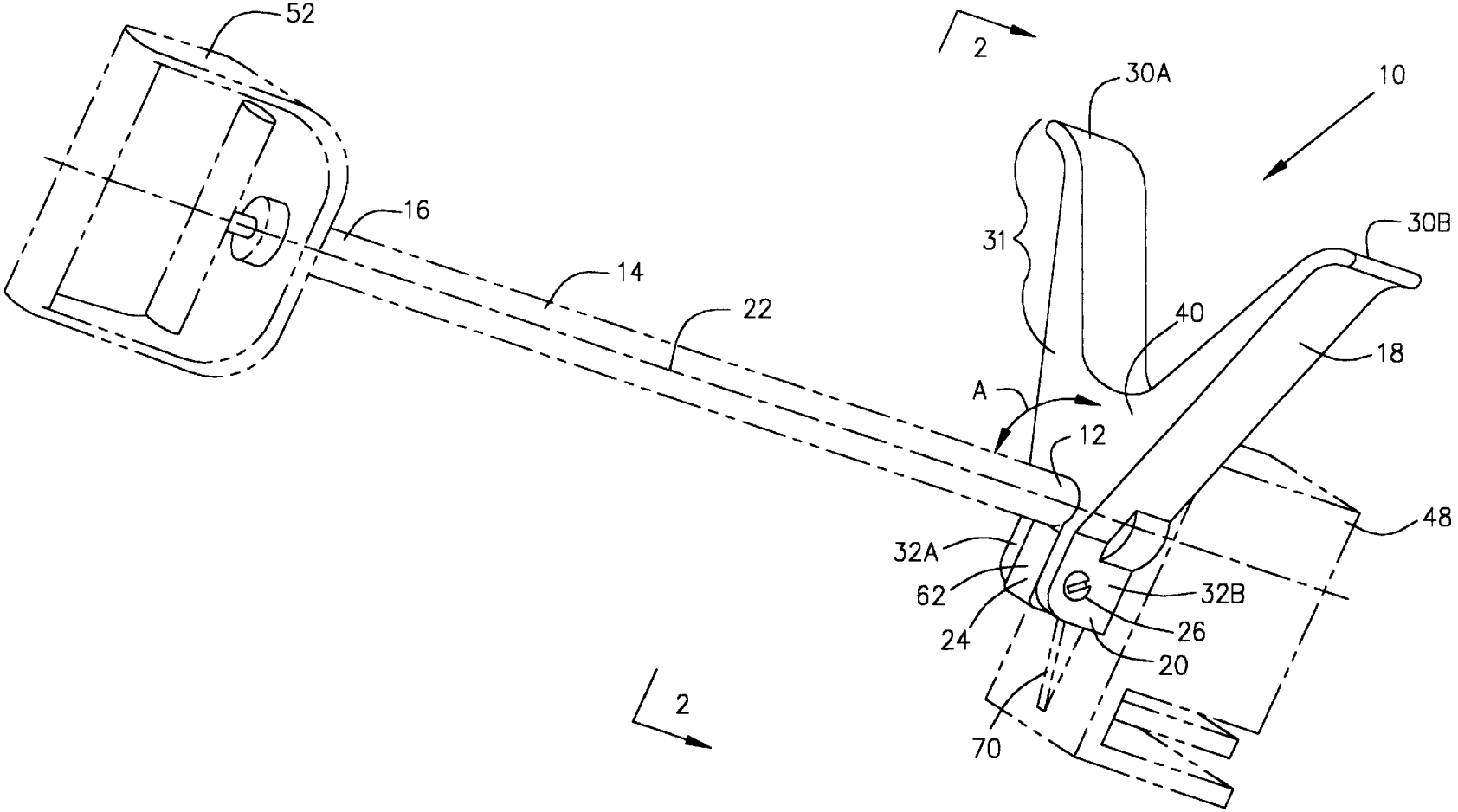
FIG. 1 is a perspective view of a boot jack constructed in accordance with a preferred embodiment of the present invention, shown attached to a handle of a device to assist a person in putting on their shoes.

Referring now to the drawings and initially to FIG. 1, there is illustrated a boot jack 10 constructed in accordance with a preferred embodiment of the present invention. The boot jack 10 is removably attachable to a distal end 12 of a rod 14 so that the boot jack 10 can be used by an individual to remove their shoes while the individual is either sitting or standing and is holding the opposite proximal end 16 of the rod 14 in their hand.

The invention is provided with a v-shaped part 18 that extends outward away from the rod 14 so that the user can place the heel of their shoe within the v-shaped part 18 to engage the shoe with the boot jack 10 while holding the proximal end 16 of the rod 14 in their hand. The v-shaped part 18 is provided with a clamping structure 20 for securing the boot jack 20 around the distal end 12 of the rod 14 so that the v-shaped part 18 of the boot jack 10 extends outward away from the rod 14 at an angle A of approximately 90 degree angle from a longitudinal axis 22 of the rod 14.

Referring now to FIGS. 2–6, the details of the boot jack 20 and its attachment to the rod 14 are illustrated. The boot jack 20 is comprised of the v-shaped part 18, a locking part 24, a bolt 26 and a nut 28.

Figure 2:
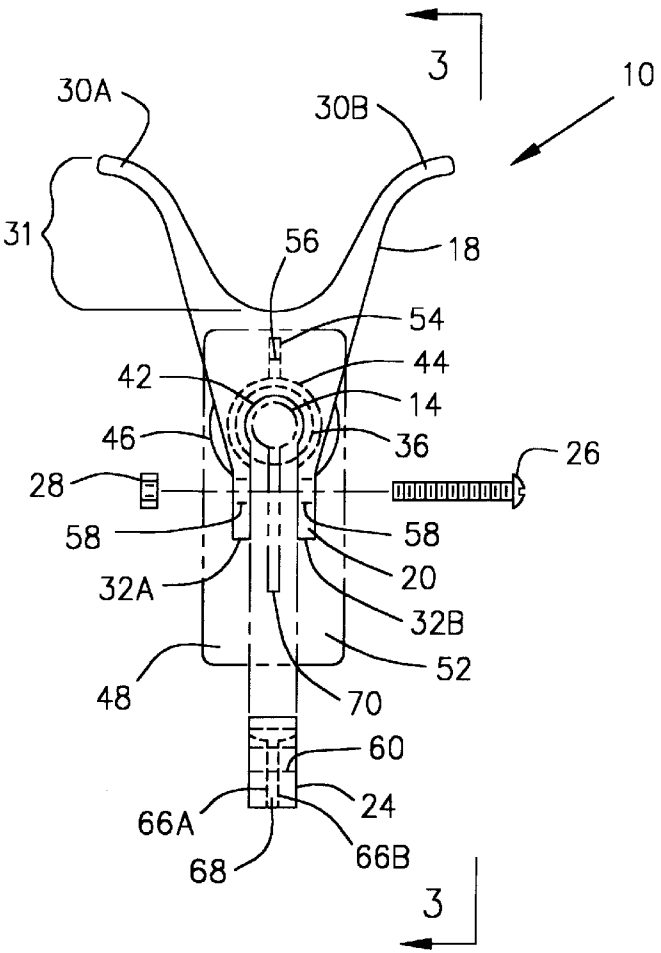
FIG. 2 is an rear view of the boot jack taken along line 2—2 of FIG. 1, shown with the bolt and the locking part separated from the rest of the boot jack.
Figure 5:
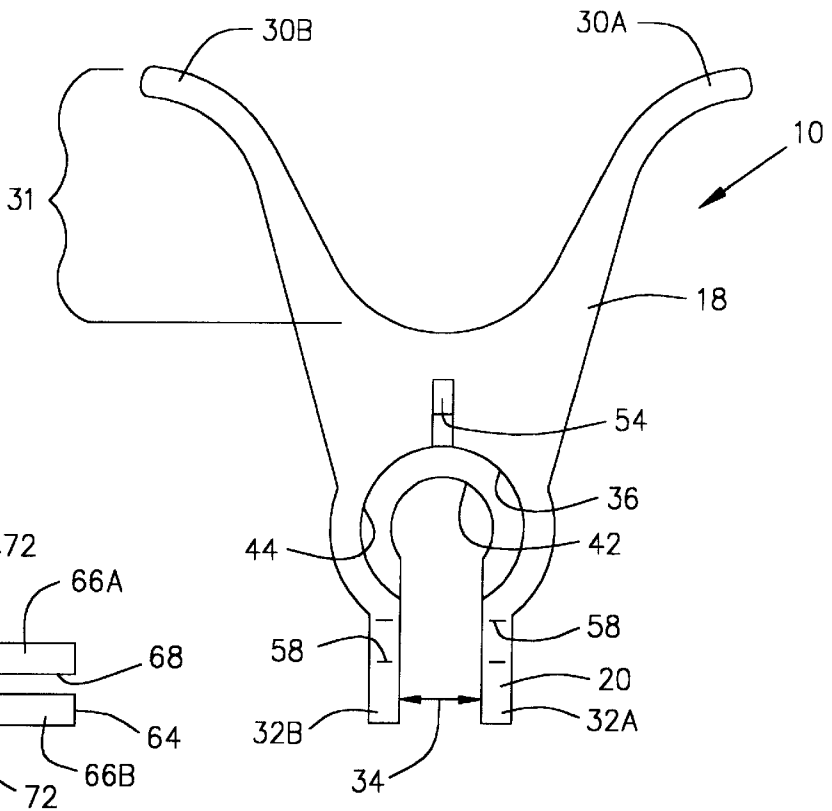
FIG. 5 is a front view of the boot jack taken along line 5—5 of FIG. 4.
Figure 5:
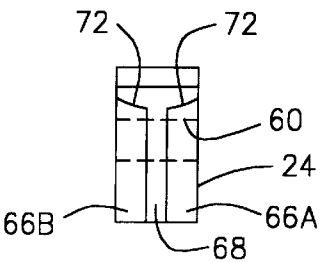

As illustrated in FIGS. 2 and 5, the v-shaped part 18 has two arms 30A and 30B that together define a v-shaped area 31 for engagement with a heal of the user's shoe in order to remove the shoe from the user's foot. The v-shaped part 18 is also provided with two legs 32A and 32B that extend in the opposite direction from the two arms 30A and 30B. The two legs 32A and 32B are spaced apart from each other so that a slot 34 is formed therebetween. The slot 34 terminates internally within the v-shaped part 18 to form a cylindrical opening 36 that is open to the slot 34 and open at both a front end 38 of the boot jack 10 and a rear end 40 of the boot jack 10.

Figure 3:
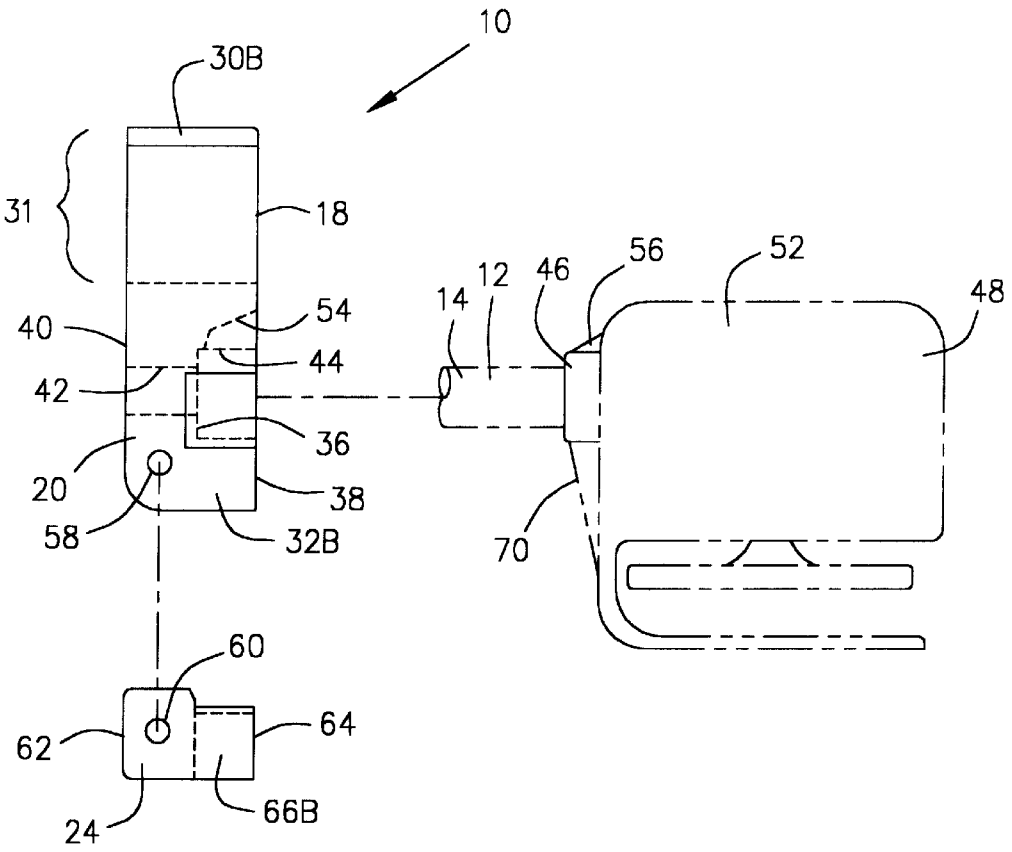
FIG. 3 is a side view of the boot jack taken along line 3—3 of FIG. 2.
Figure 4:
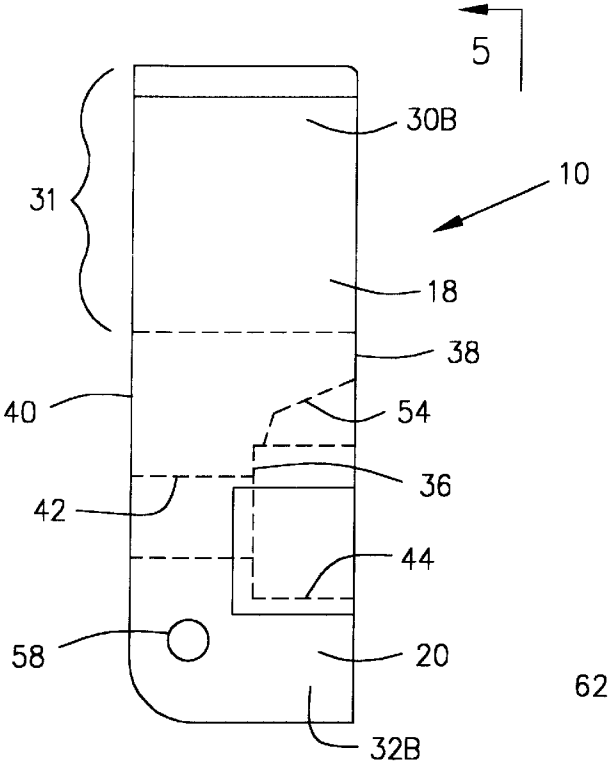
FIG. 4 is an enlarged view of the boot jack of FIG. 3 shown removed from the device to assist a person in putting on their shoes.
Figure 4:
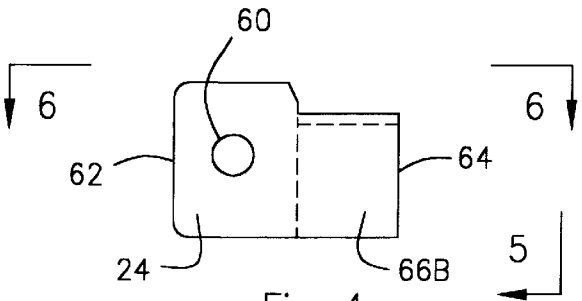

As illustrated in FIGS. 3 and 4, the cylindrical opening 36 consists of two portions, a smaller portion 42 located adjacent the rear end 40 and a larger portion 44 located adjacent the front end 38. The slot 34 is large enough to allow the rod 14 to enter the cylindrical opening 36, and the smaller portion 44 of the cylindrical opening 36 is large enough to receive the rod 14. The larger portion 44 of the cylindrical opening 36 is large enough to receive a cylindrical neck 46 associated with a clamping end 48 provided on the rod 14 when the rod 14 is part of a device 52 to assist a person in putting on their shoes. Also, the v-shaped part 18 is provided with a groove 54 located adjacent to the larger portion 44 and extending toward the arms 30A and 30B. The purpose of the groove 54 is to receive therein a ridge 56 provided on the cylindrical neck 46 as a way of preventing the boot jack 10 from rotating on the rod 14.

Figure 6:
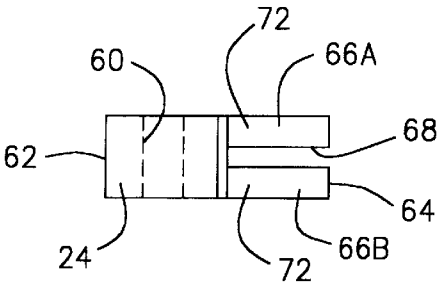
FIG. 6 is a top view of the locking part taken along line 6—6 of FIG. 4.

Each of the legs 32A and 32B is provided with a bolt opening 58 therethrough so that the two bolt openings 58 are aligned with each other. Once the v-shaped part 18 has been placed around the rod 14 so that the v-shaped part 18 abuts the clamping end 48 and the ridge 56 enters the groove 54, the locking part 24 is placed between the legs 32A and 32B. The locking part 24 is provided with a bolt opening 60 extending through a rear end 62 of the locking part 24. As illustrated in FIG. 6, a front end 64 of the locking part 24 is provided with two extensions 66A and 66B, that form a groove 68 therebetween. The groove 68 receives a second ridge 70 provided on the cylindrical neck 46 as a means of preventing the locking part 24 from rotating. Once the locking part 24 is inserted between the legs 32A and 32B so that the ridge 70 lies within the groove 68, the bolt opening 60 in the locking part 24 aligns with the bolt openings 58 is legs 32A and 32B. The bolt 26 inserts through the alighted bolt openings 58, 60, and 58 and is secured therein by the nut 28 in order to secure the boot jack 10 to the rod 14.

As best illustrated in FIG. 5, in order to properly fit to the cylindrical neck 46, each of the extensions 66A and 66B is provided with a concave face 72 that engages with the cylindrical neck 46 when the locking part 24 is thus secured to the v-shaped part 18.

To remove the boot jack 10 from the rod 14, the nut 28 is first loosened and removed from the bolt 26. The bolt 26 is next removed from the bolt openings 58, 60, and 58, thus freeing the locking part 24 and the v-shaped part 18 so that they can be slipped free of the rod 14.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A boot jack comprising a v-shaped part having two spaced apart arms for removably engaging a heel of a shoe that is to be removed from a user's foot, a clamping structure provided on the v-shaped part for removably securing the v-shaped part to a rod so that the v-shaped part extends outward from the rod at approximately a 90 degree angle from a longitudinal axis of the rod, two legs provided on said v-shaped part so that the two legs extend in an opposition direction to the direction in which the arms extend, said legs forming a slot therebetween for admittance of a rod, each leg provided with a bolt opening therethrough, a bolt extending through said bolt openings, and a nut engagable with said bolt to secure the v-shaped part to the rod.

2. A boot jack according to claim 1 wherein said clamping structure further comprises:

a locking part insertable between said legs, said locking part provided with a bolt opening therethrough so that said bolt extends through the bolt openings of the legs and the locking part to secure the locking part between the legs.

3. A boot jack according to claim 2 further comprising:

a groove in said v-shaped part for removable engagement with a ridge in a clamping head attached at a distal end of the rod, and a groove in said locking part for removable engagement with a second ridge in a clamping head attached at a distal end of the rod.

4. A boot jack according to claim 3 further comprising:

said v-shaped part provided with a cylindrical opening communicating with the slot for removably receiving a rod therein.

5. A boot jack according to claim 4 further comprising:

said cylindrical opening provided with a smaller portion for removably receiving a rod, and said cylindrical opening provided with a larger portion for removably receiving a cylindrical neck on a clamping head attached at a distal end of the rod.

* * * * *